US006681891B2

(12) United States Patent
Richard et al.

(10) Patent No.: US 6,681,891 B2
(45) Date of Patent: Jan. 27, 2004

(54) BELAYING DESCENDING DEVICE FOR CLIMBING OR MOUNTAINEERING

(75) Inventors: Lionel Richard, Le Touvet (FR); Alain Maurice, Meylan (FR)

(73) Assignee: Zedel, Crolles (FR)

( * ) Notice: Subject to any disclaimer, the term of this patent is extended or adjusted under 35 U.S.C. 154(b) by 9 days.

(21) Appl. No.: 10/022,233

(22) Filed: Dec. 20, 2001

(65) Prior Publication Data

US 2002/0084139 A1 Jul. 4, 2002

(30) Foreign Application Priority Data

Jan. 4, 2001 (FR) ..... 01 00152

(51) Int. Cl.[7] ..... A47L 3/04; A62B 1/20
(52) U.S. Cl. ..... 182/5; 182/192
(58) Field of Search ..... 182/5, 36, 3, 193, 182/72, 192, 191; 188/65.4, 65.5, 65.2

(56) References Cited

U.S. PATENT DOCUMENTS

| | | | | | |
|---|---|---|---|---|---|
| 4,311,218 | A | * | 1/1982 | Steffen | 182/5 X |
| 4,678,059 | A | * | 7/1987 | Bowker | 182/5 |
| 5,934,408 | A | * | 8/1999 | Flux | 182/5 |
| 6,085,866 | A | * | 7/2000 | Kowalewski | 182/5 |
| 6,095,282 | A | * | 8/2000 | Sadeck | 182/6 |
| 6,378,650 | B2 | * | 4/2002 | Mauthner | 182/5 |
| 6,467,574 | B2 | * | 10/2002 | Lara | 182/36 |

FOREIGN PATENT DOCUMENTS

| | | | | |
|---|---|---|---|---|
| DE | 89 04 030 U1 | | 5/1989 | |
| FR | 2564736 | * | 11/1985 | 182/5 |
| FR | 2 600 898 A1 | | 1/1988 | |
| FR | 2 688 142 A1 | | 9/1993 | |
| GB | 2162620 | * | 2/1986 | 182/5 |

* cited by examiner

*Primary Examiner*—Hugh B. Thompson
(74) *Attorney, Agent, or Firm*—Oliff & Berridge, PLC

(57) ABSTRACT

A belaying descending device for belaying a leading or second mountain climber, and for controlled descending along a single or double rope, including a metal body having a pair of slits at least one slit for the rope to pass through, a first opening in the form of a securing bow for receiving a first snap-hook in a manner that at least one loop of the rope may pass through the first snap-hook, a second suspension opening for receiving a second snap-hook in the case of belaying of the second climber, and fixed stop means transversely offset with respect to said openings for limiting the movement of the rope through the slits.

10 Claims, 9 Drawing Sheets

BELAYING DESCENDING DEVICE FOR CLIMBING OR MOUNTAINEERING

BACKGROUND OF THE INVENTION

The invention relates to a belaying descending device for climbing or mountaineering, in particular for belaying the leading or second climber, and for controlled descending along a single or double rope.

STATE OF THE ART

Known belaying systems are formed either by a figure-of-eight descender made of moulded or forged aluminum alloy or by plates with one or two oblong slits. In the event of the climber falling, blocking is performed by friction effect on the rope, stopping the climber's fall.

Some of these plates are associated to a securing cable in the form of a loop extending perpendicularly to the plane of the plate. Others comprise holes for attaching a snap-hook, but all the holes and slits are located in the same plane.

These different known belaying systems are not always easy to operate when climbers are climbing in risky terrain.

OBJECT OF THE INVENTION

The object of the invention is to achieve a belaying descending device facilitating handling operations when switching between the different belaying modes of the leading and second climber and use as a descender.

The device according to the invention is characterized in that it comprises a metal body having:

- at least one slit for the rope to pass,
- a first opening in the form of a securing bow for attaching a first snap-hook designed to pass through at least one loop of the rope,
- a second suspension opening for passing a second snap-hook in the case of belaying of the second climber,
- and stop means transversely offset with respect to said openings for blocking the rope.

According to a preferred embodiment of the invention, the metal body is achieved by cutting and folding a sheet metal plate. It is composed of a central flange-plate whereon a U-shaped bracket is fitted bounding two symmetrical slits on each side of the flange-plate. The two openings are arranged in the flange-plate extending in the vertical mid-plane. The first opening in the form of a bow is larger than the second opening. The body of the bracket is provided in the middle zone with two centering grooves designed to engage in the flange-plate.

According to one feature of the invention, the assembly means pass through the ends of the bracket and of the flange-plate with two interposed sleeves forming said stop means for blocking the rope. Preferably, each sleeve is fixed and closes the corresponding slit opposite the body in the narrow part of the bracket.

According to another feature of the invention, a boss is arranged on each sleeve facing the inside of the bracket to improve blocking of the rope.

According to another feature, each sleeve comprises at least one pin designed to enter an additional hole of the flange-plate transversely so as to block said sleeve in rotation.

The hole presents a rectangular shape with a circular central part for the assembly means to pass.

BRIEF DESCRIPTION OF THE DRAWINGS

Other advantages and features will become more clearly apparent from the following description of an embodiment of the invention given as a non-restrictive example only and represented in the accompanying drawings, in which.

DESCRIPTION OF A PREFERRED EMBODIMENT

Figure 1:
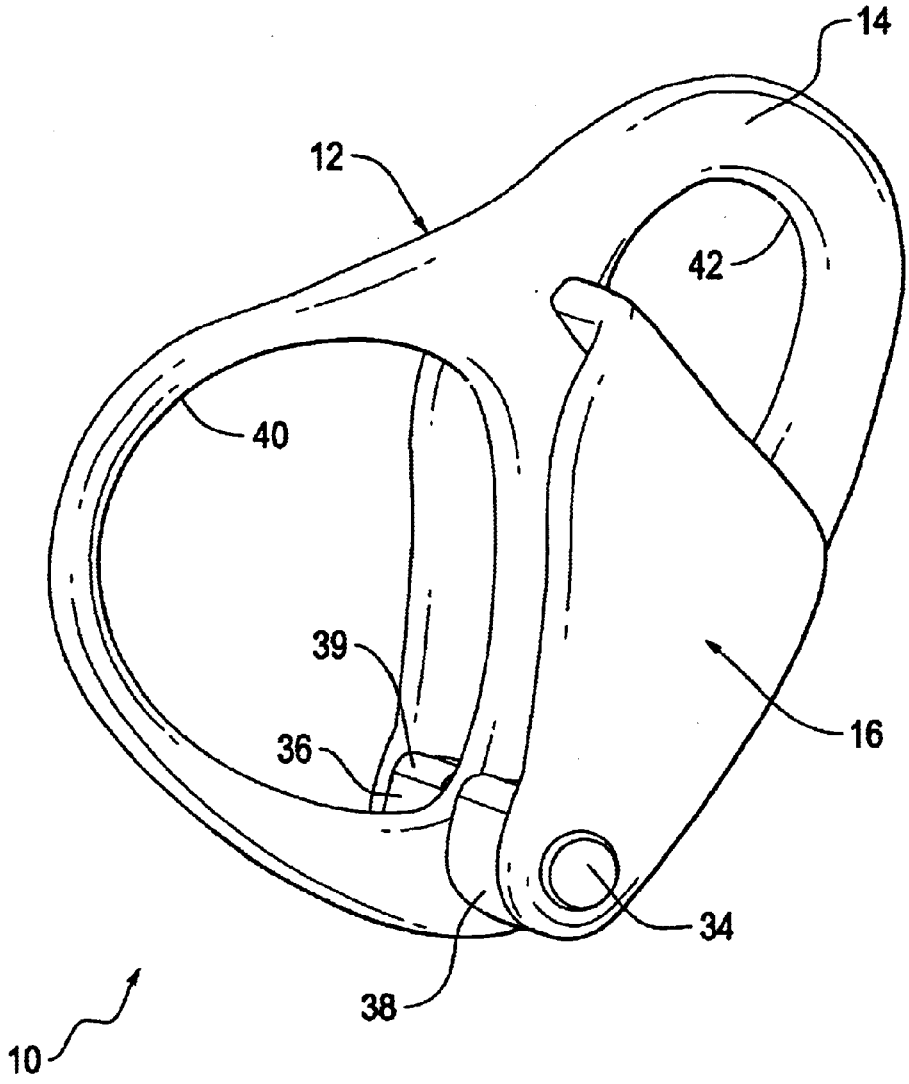
FIGS. 1 and 2 are perspective views of the belaying descending device according to the invention.
Figure 2:
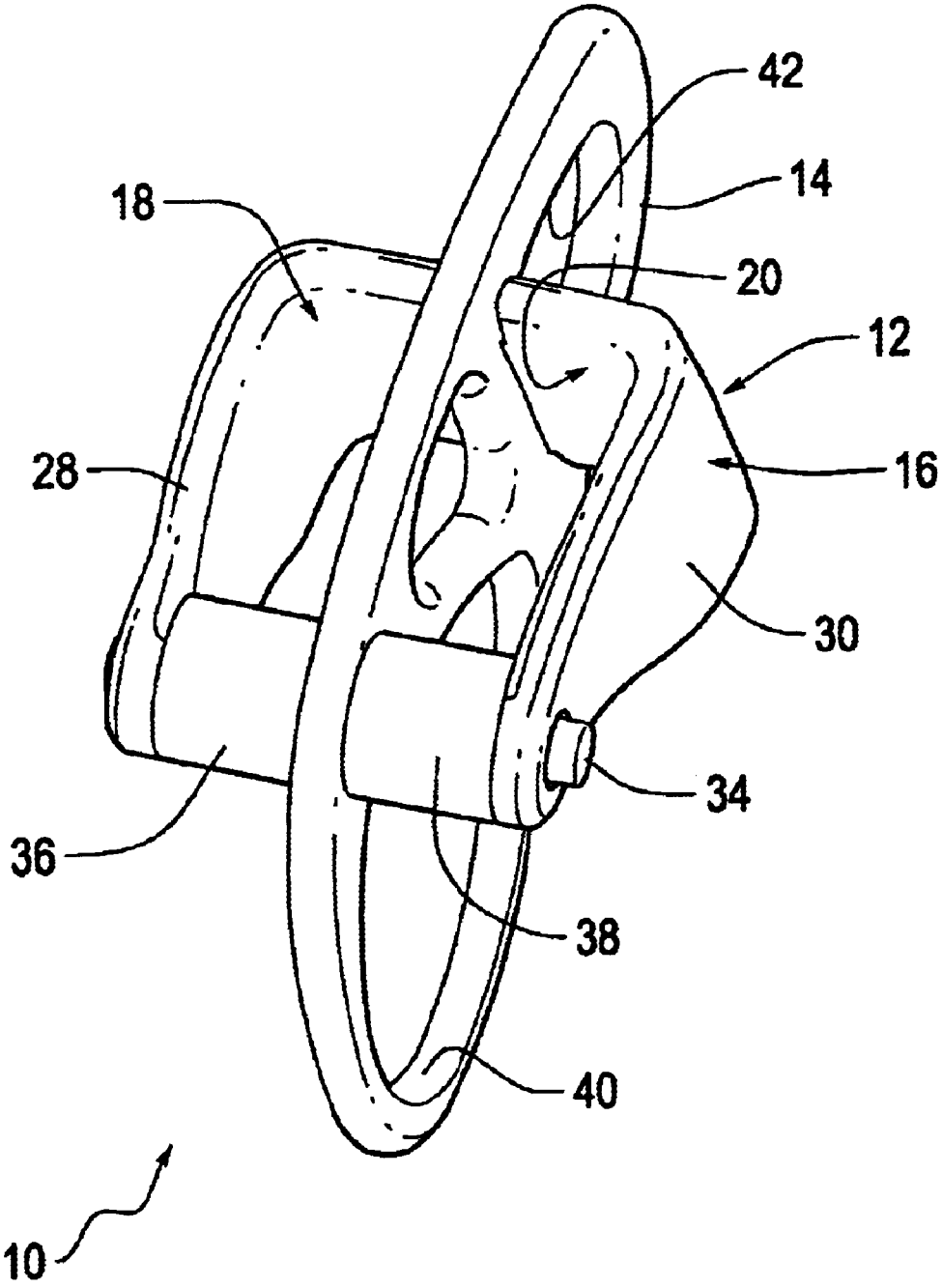
Figure 3:
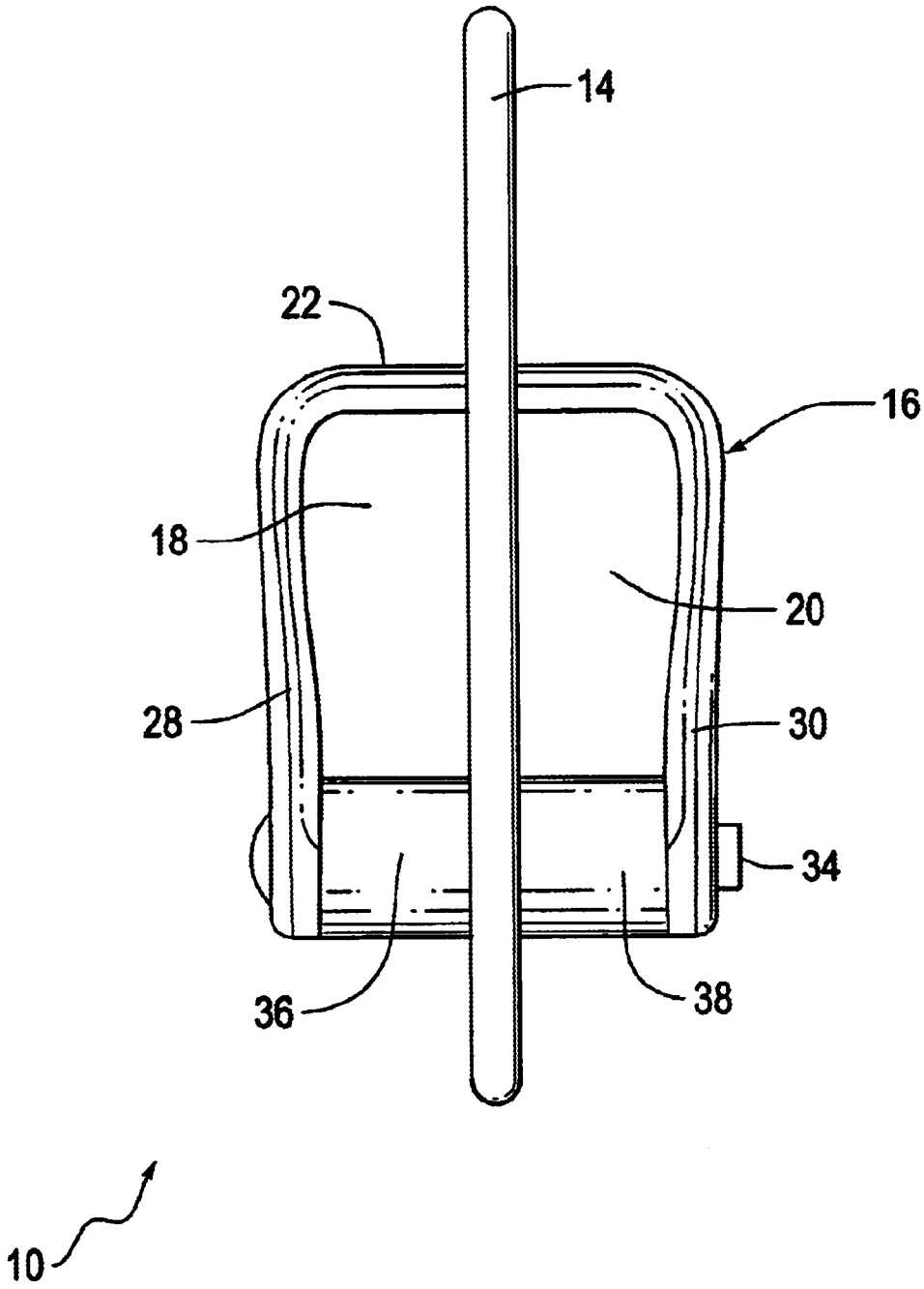
FIG. 3 shows a side view of FIG. 1.
Figure 4:
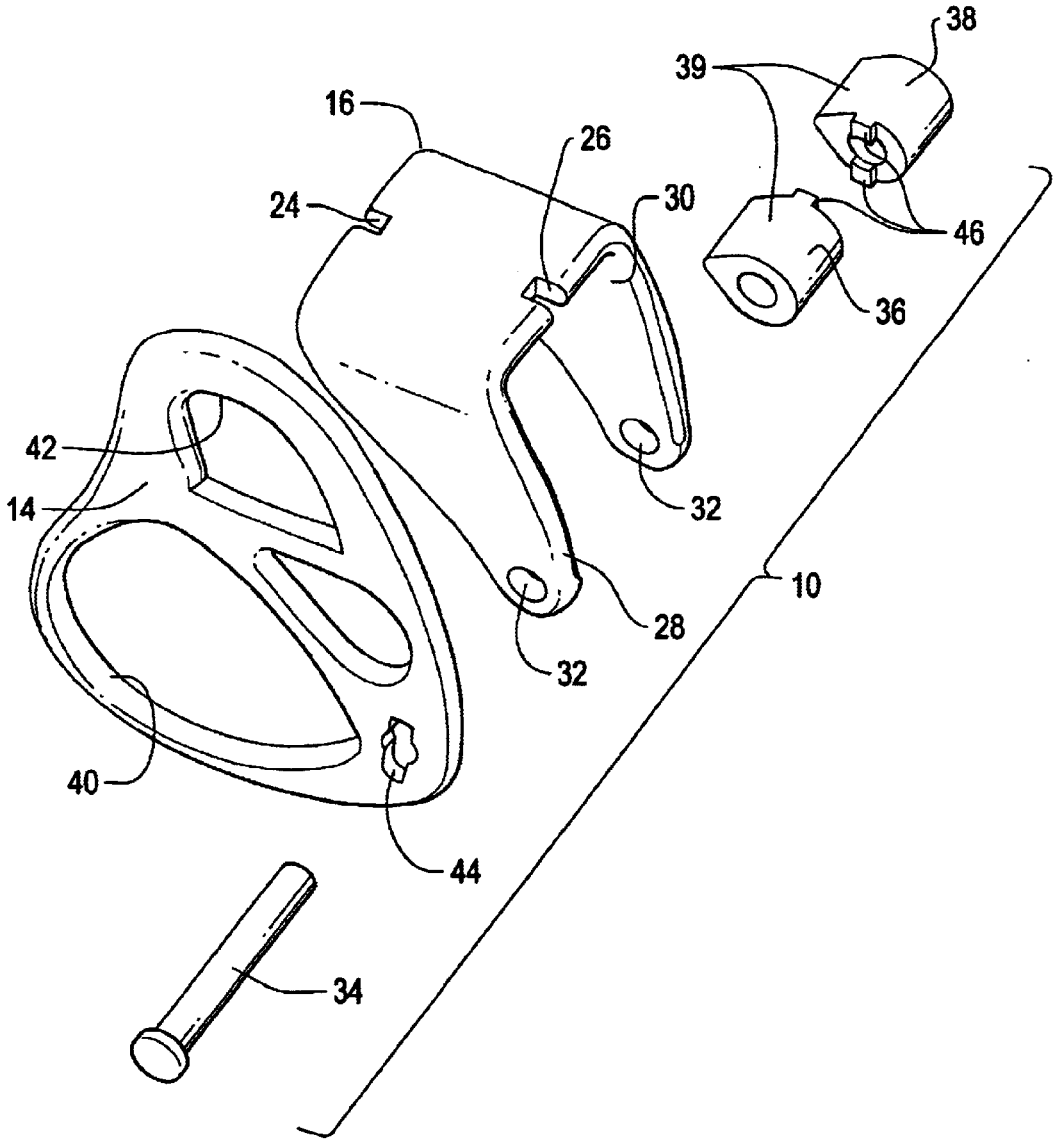
FIG. 4 represents an exploded perspective view of the belaying descending device of FIG. 3.

With reference to FIGS. 1 to 4, a belaying descending device 10 for climbing or mountaineering comprises a metal body 12 composed of a central flange-plate 14 whereon a U-shaped bracket 16 is fitted so as to two define adjacent slits 18, 20 for the rope to pass through.

The body 22 of the bracket 16 is provided in the middle zone with two centering grooves 24, 26 aligned in the plane of the flange-plate 14 and each having a slightly larger thickness than that of the flange-plate 14. The ends of the two symmetrical wings 28, 30 of the bracket 16 are provided with circular holes 32 designed to receive an assembly means 34, for example a rivet, passing coaxially through two sleeves 36, 38 and the flange-plate 14 in the transverse direction. Each sleeve 36, 38 forms a fixed stop means that closes the corresponding slit 18, 20 opposite the body 22 and in the narrow part of the bracket 16. A boss 39 is arranged on each sleeve 36, 38 to improve blocking of the rope in the event of a fall.

The flange-plate 14 extends in the vertical mid-plane and comprises a first opening 40 in the form of a securing bow and a second opening 42 for attaching a snap-hook in case of belaying the second climber. An additional hole 44 of rectangular shape is also provided in the flange-plate 14 to enable the passage of the assembly means 34 and insertion of two pins 46 salient in the transverse direction from each sleeve 36, 38. The central part of the hole 44 is circular and presents a slightly larger diameter than that of the rivet.

When fitting of the bracket 16 is performed, the two centering grooves 24, 26 of the body 22 engage in the central part of the flange-plate 14. The two fixed sleeves 36, 38 are blocked in rotation once the pins 46 have entered the rectangular hole 44 of the flange-plate 14, and the bosses 39 are facing the inside of the bracket 16. The body 22 forms an inclined plane arranged between the second opening 42 and the two fixed sleeves 36, 38.

The belaying descending device 10 according to FIGS. 1 to 4 is achieved by cutting and folding of an aluminum or stainless steel plate, but it is clear that the latter may be forged.

The different modes of use of the belaying descending device 10 according to the invention are as follows:

The device can be used with a single rope or a double rope. In the case of a single rope (not represented), a loop of the rope passes longitudinally through a single sit 18 or 20 in an offset plane parallel to the flange-plate 14. In the case of a double rope, the two slits 18, 20 are used with two loops of rope extending parallel on each side of the flange-plate 14.

The following figures illustrate installation of the belaying descending device 10 with the second case with a double rope.

Figure 5:
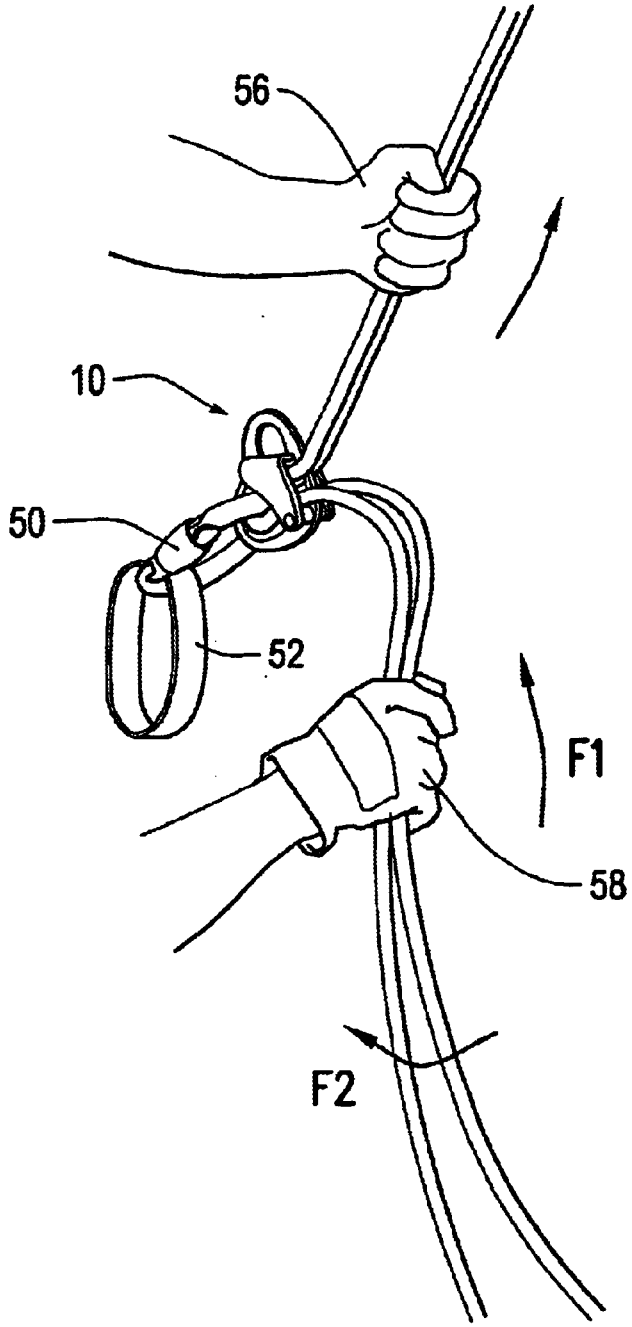
FIG. 5 illustrates the mode of use of the device for belaying the leading climber.
Figure 6:
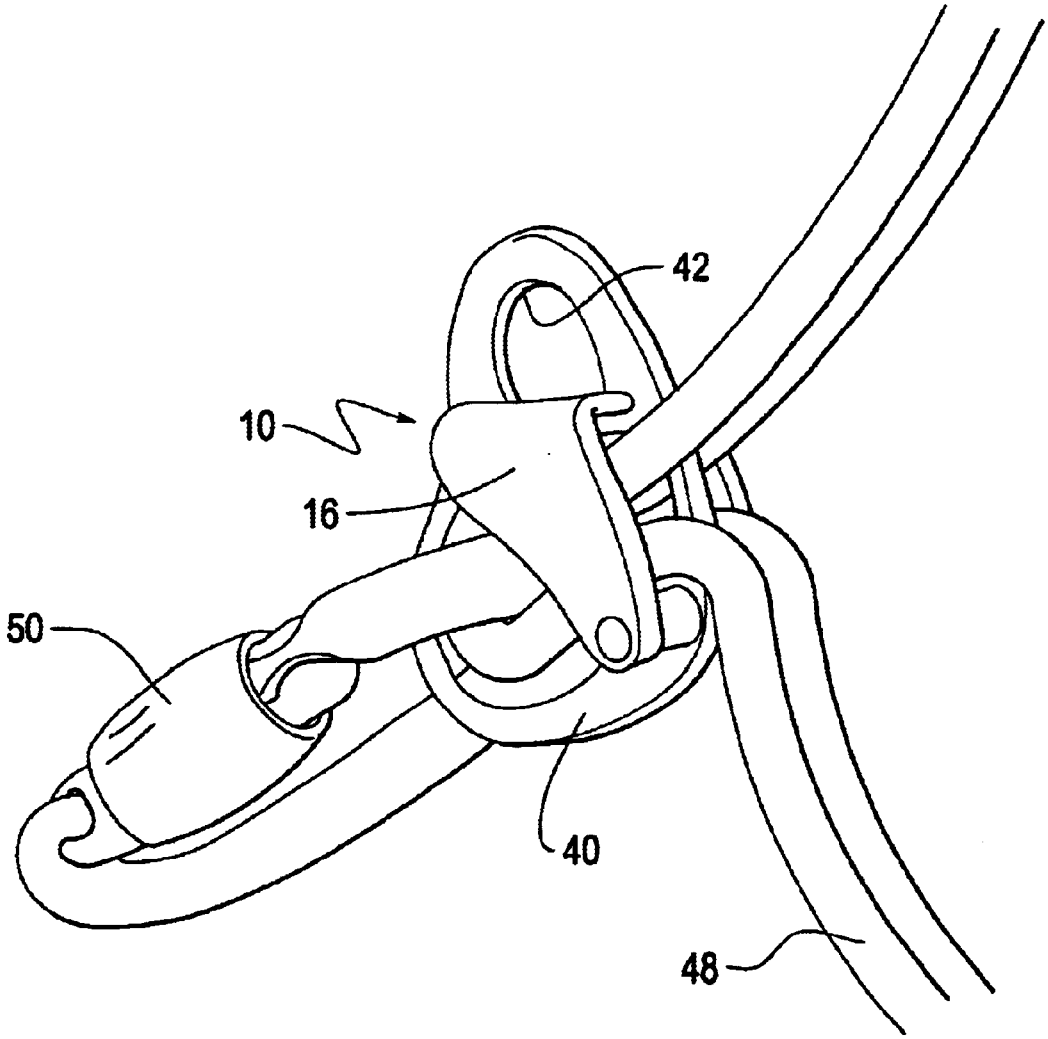
FIG. 6 is a detailed view of FIG. 5 on an enlarged scale.

Belaying the Leading Climber (FIGS. 5 and 6).

The leading climber is climbing and is belayed by the second climber who is underneath. Two loops of the double rope 48 are housed in the slits 18, 20 of the belaying descending device 10 and a first snap-hook 50 passes through the two loops and the bow 40, being attached to the ring 52 of the harness 54 belonging to the second climber. One of the second climber's hands 56 is holding the upper strands of the rope attached to the leading climber and his other hand 58 is round the lower strands. The second opening 42 of the flange-plate 14 is not used in this belaying mode.

During normal progression of the leading climber, the second climber's hand 58 simply has to give some slack in the direction of the arrow F1 to allow the rope 48 to slide freely in the device.

To block the leading climber, in particular in the event of a fall, the second climber clasps the lower strands with his hand 58 pulling the rope 48 in the direction of the arrow F2. This results in the loops of rope being jammed on the bosses 39 of the sleeves 36, 38 blocking the upper strands of the rope 48.

Figure 7:
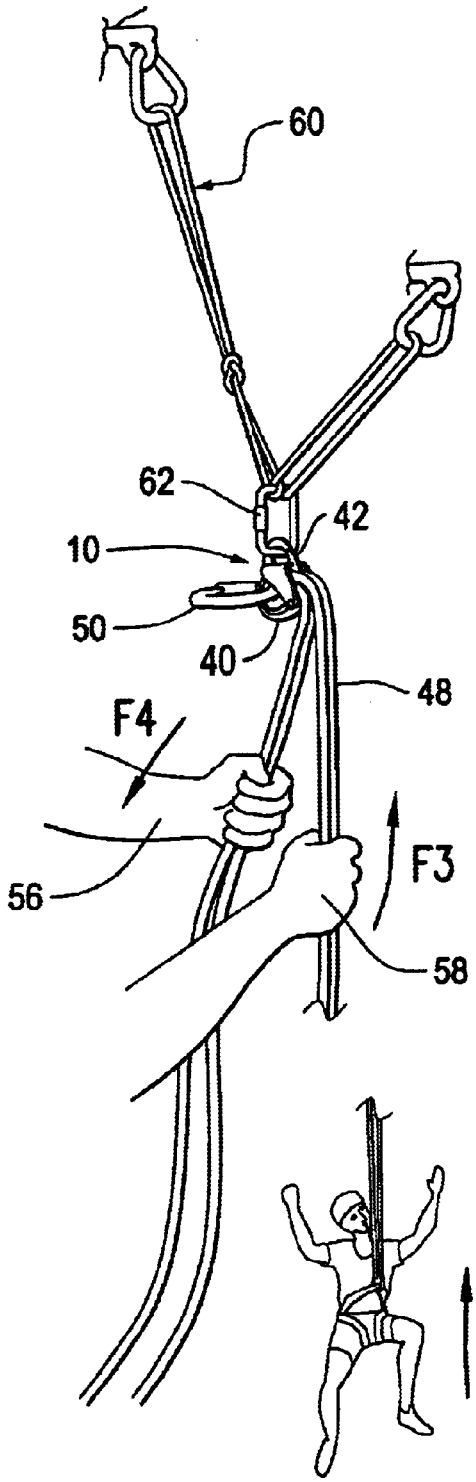
FIG. 7 illustrates the mode of use of the device for belaying the second climber.
Figure 8:
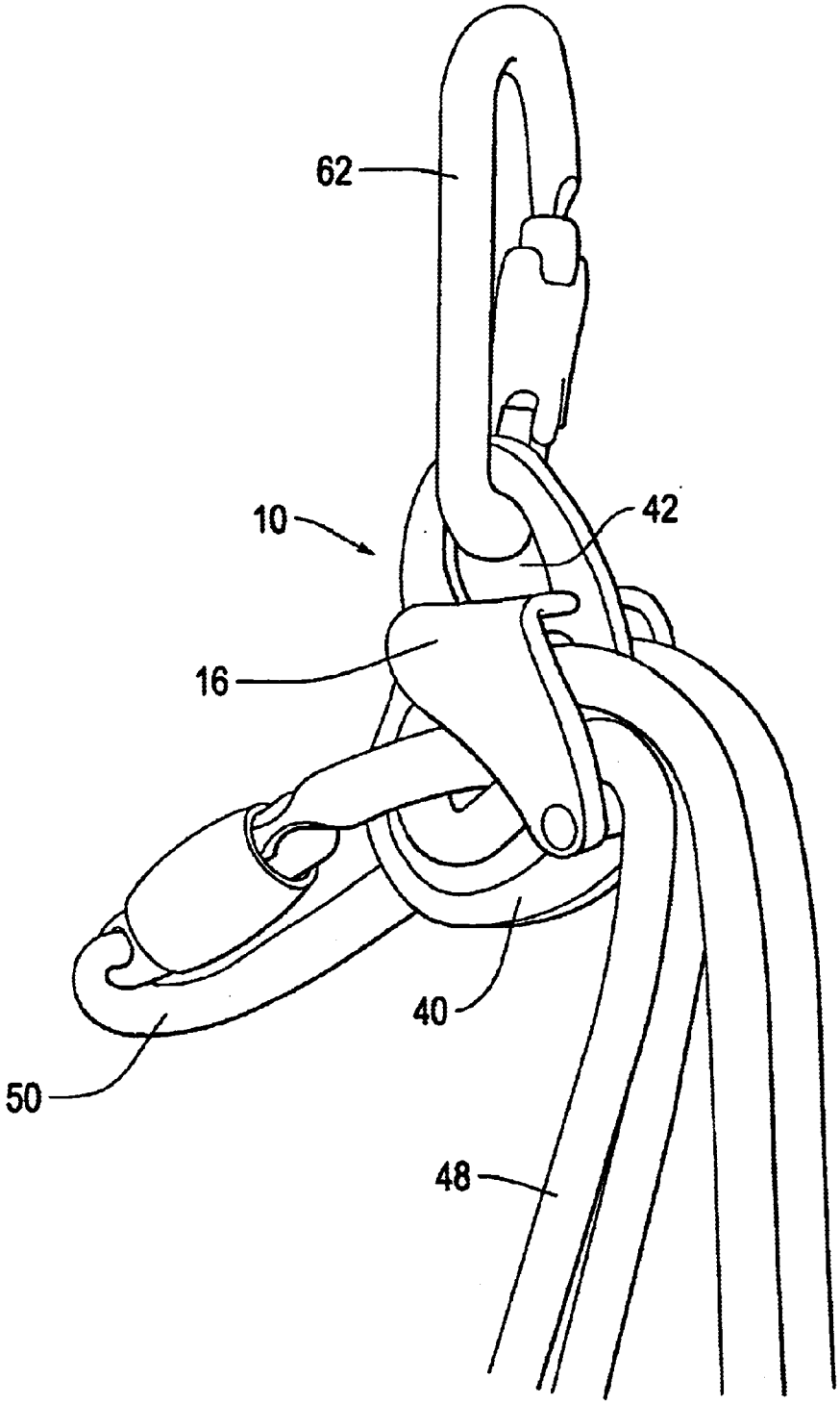
FIG. 8 is a detailed view of FIG. 7 on an enlarged scale.

Belaying the Second Climber (FIGS. 7 and 8).

The second climber is climbing and is belayed by the leading climber who is above him, in particular at a relay point. The rope 48 is attached to the second climber's harness and the first snap-hook 50 passes through the bow 40 and the loops of rope of the leading climber's device 10, but without being attached to the latter's harness. The device 10 is attached to fixed securing means 60 by a second snap-hook 62 passing through the second opening 42 of the flange-plate 14.

During normal progression of the second climber, the rope can slide freely in the device 10, and the leading climber's hands 56, 58 accompany the movement of the rope 48 (arrows F3 and F4) so as to take up the slack on the section between the second climber and the device 10 as this slack forms.

Should the second climber fall, instantaneous blocking of the jamming device 10 is automatic resulting in the fall being stopped. The shocks are completely absorbed by the device 10 and the fixed securing means 60.

Figure 9:
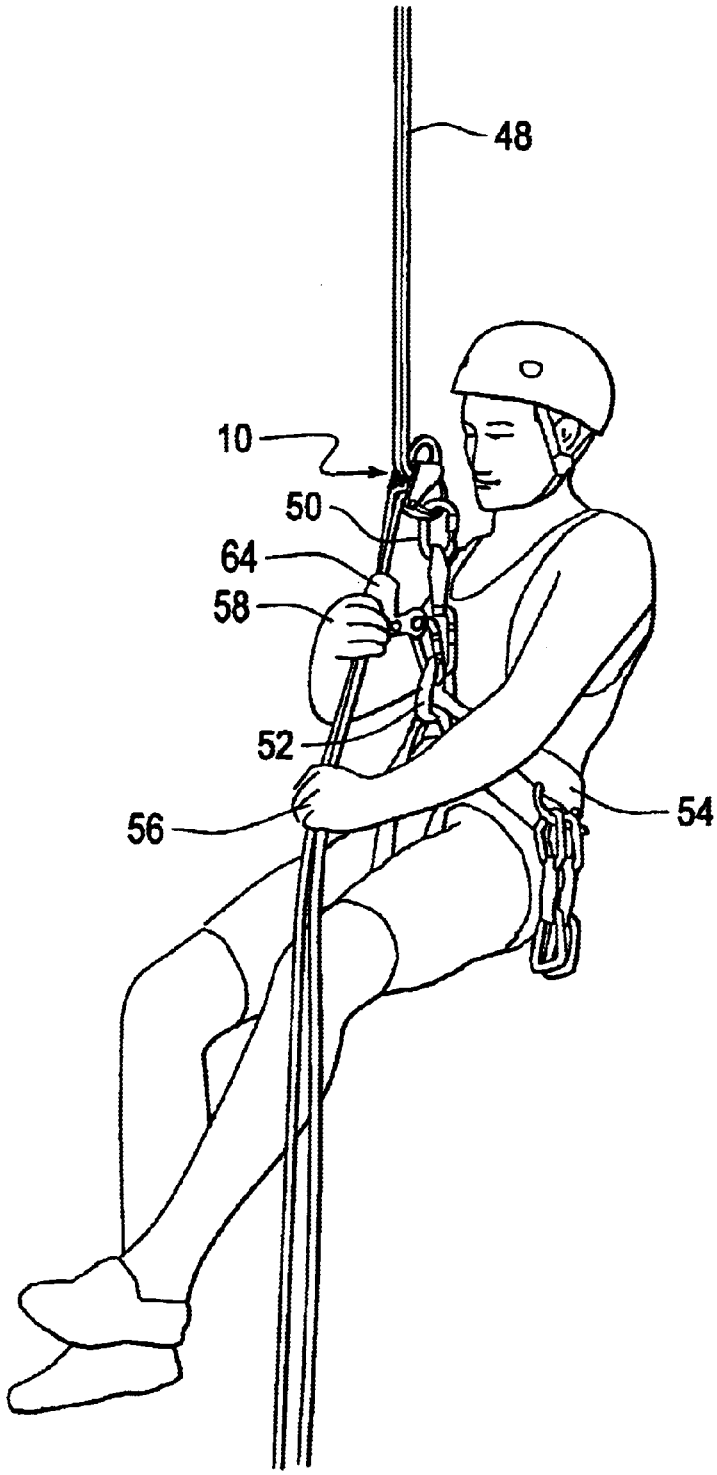
FIG. 9 shows the mode of use as a descender.

Descender (FIG. 9).

The device 10 is used as in the case of FIGS. 5 and 6 but in the descending direction. It then behaves as a descender with the first snap-hook 50 attached to the harness 54. To brake or stop the descending movement, the rope simply has to be pulled more or less strongly with the hand 56 as is done in conventional manner with simple descenders. An additional rappelling safety element 64 can be fitted on the lower strands and controlled by the other hand 58.

What is claimed is:

1. A belaying descending device for belaying a leading or second mountain climber, and for controlled descending along a single or double rope, comprising a metal body having:

a pair of slits at least one slit for the rope to pass through, a first opening in the form of a securing bow for receiving a first snap-hook in a manner that at least one loop of the rope may pass through the first snap-hook, a second suspension opening for receiving a second snap-hook in the case of belaying of the second climber, and fixed stop means transversely offset with respect to said openings for limiting the movement of the rope through the slits.

2. The belaying descending device according to claim 1, wherein the metal body is composed of a central flange-plate whereon a U-shaped bracket is fitted bounding the pair of slits on each side of the flange-plate.

3. The belaying descending device according to claim 2, wherein the two openings are arranged in the flange-plate extending in the vertical mid-plane.

4. The belaying descending device according to claim 3, wherein the first opening in the form of a bow is larger than the second opening.

5. The belaying descending device according to claim 2, wherein said bracket has a middle zone provided with two centering grooves designed to engage in the flange-plate.

6. The belaying descending device according to claim 2, wherein assembly means pass through the bracket and the flange-plate with two interposed sleeves forming said stop means for blocking the rope.

7. The belaying descending device according 6, wherein each sleeve is fixed and closes the corresponding slit opposite the body in the narrow part of the bracket.

8. The belaying descending device according to claim 7, wherein a boss is arranged on each sleeve inside the bracket to improve blocking of the rope.

9. The belaying descending device according to claim 6, wherein each sleeve comprises at least one pin designed to enter an additional hole of the flange-plate transversely to block said sleeve in rotation.

10. The belaying descending device according to claim 9, wherein the hole presents a rectangular shape with a circular central part for the assembly means to pass.

* * * * *